United States Patent [19]

Garton et al.

[11] Patent Number: 5,076,454

[45] **Date of Patent: * Dec. 31, 1991**

[54] KNOCK-DOWN SHIPPING AND STORAGE CONTAINER

[75] Inventors: Richard K. Garton, Fort Wayne, Ind.; Ronald E. Ernsberger, Grand Rapids, Ohio; Gordon B. Graef, Fort Wayne, Ind.; Louis Vigliotti, Jr., Fort Wayne, Ind.; Barry W. Worman, Fort Wayne, Ind.

[73] Assignee: North American Van Lines, Inc., Fort Wayne, Ind.

[ * ] Notice: The portion of the term of this patent subsequent to Aug. 14, 2007 has been disclaimed.

[21] Appl. No.: 475,788

[22] Filed: Feb. 6, 1990

Related U.S. Application Data

[63] Continuation-in-part of Ser. No. 307,627, Feb. 7, 1989, Pat. No. 4,948,005.

[51] Int. Cl.[5] ..... B65D 7/00

[52] U.S. Cl. ..... 220/1.5; 220/4.26; 220/4.28

[58] Field of Search ..... 220/1.5, 4.26, 4.28

[56] References Cited

U.S. PATENT DOCUMENTS

| | | | |
|---|---|---|---|
| 1,817,307 | 8/1931 | Haase et al. . | |
| 2,869,750 | 1/1959 | Doerr et al. | 220/4 |
| 2,919,826 | 1/1960 | Richter | 220/1.5 |
| 3,093,259 | 6/1963 | Morrison | 220/4 F |
| 3,101,154 | 8/1963 | Herdering | 220/4 |
| 3,261,493 | 7/1966 | Smith | 217/65 |
| 3,405,835 | 10/1968 | Eby | 220/4 |
| 3,517,849 | 6/1970 | Presnick | 220/4 |
| 3,561,633 | 2/1971 | Morrison | 220/1.5 |
| 3,584,757 | 5/1971 | Blaisdell | 220/4 R |
| 3,598,273 | 8/1971 | Rau | 220/1.5 |
| 3,655,087 | 4/1972 | Luisada | 220/1.5 |
| 3,784,043 | 1/1974 | Presnick | 220/4 F |
| 3,940,007 | 2/1976 | Griffiths | 220/4 F |
| 3,989,157 | 11/1976 | Veenema | 220/4 F |
| 3,997,072 | 12/1976 | Guth | 220/1 T |
| 3,999,676 | 12/1976 | Trebilcock | 220/6 |
| 4,000,827 | 1/1977 | Emery | 220/4 F |
| 4,020,967 | 5/1977 | Hammond et al. | 220/6 |
| 4,181,236 | 1/1980 | Prodel | 220/6 |
| 4,212,415 | 7/1980 | Neely | 222/231 |
| 4,212,415 | 7/1980 | Neely | 222/231 |
| 4,239,149 | 12/1984 | Kupersmit | 229/45 R |
| 4,456,142 | 6/1984 | Burling | 220/4 F |
| 4,461,395 | 7/1984 | Burnett | 217/12 R |
| 4,492,153 | 1/1985 | Grabowski | 99/460 |
| 4,546,896 | 10/1985 | Reid | 220/4 F |
| 4,560,079 | 12/1985 | Eddleston et al. | 220/2 F |
| 4,591,065 | 5/1986 | Foy | 220/7 |
| 4,625,880 | 12/1986 | Pym | 220/4 F |
| 4,635,809 | 1/1987 | Bachman et al. | 220/4 B |
| 4,652,969 | 3/1987 | Stegenga | 361/384 |
| 4,674,647 | 6/1987 | Gyenge et al. | 220/6 |
| 4,948,005 | 8/1990 | Garton et al. | 220/1.5 |

FOREIGN PATENT DOCUMENTS

| | | |
|---|---|---|
| 2312723 | 5/1975 | France . |
| 2205085 | 5/1988 | United Kingdom . |

*Primary Examiner*—Steven M. Pollard
*Attorney, Agent, or Firm*—Baker & Daniels

[57] ABSTRACT

The present invention is a container for transportation and storage. It comprises a base and side panels for positioning on the base to form a universal storage container. The side panels have a panel structure for maintaining the structural integrity of the side panel, with at least one latch near a lower edge for securely attaching the panel to the base. The vertical edges of the side panels have universal joints to interconnect the panels. Also, a cover can be provided and the panels can include at least one latch near an upper edge for securely attaching the side panel to the cover. In another embodiment, plastic support braces extend between side panels to support articles, boxes, or shelves inside the container. The support braces are held in place by tether pins located in shelving recesses of the side panels.

20 Claims, 8 Drawing Sheets

KNOCK-DOWN SHIPPING AND STORAGE CONTAINER

CROSS-REFERENCE TO RELATED APPLICATIONS

This application is a continuation-in-part of the copending application entitled KNOCK-DOWN SHIPPING AND STORAGE CONTAINER, filed Feb. 7, 1989, Ser. No. 307,627, now U.S. Pat. No. 4,948,005.

BACKGROUND OF THE INVENTION

The field of the invention is that of shipping and storage containers. More specifically, the field is that of reusable, knock-down storage containers used for transporting goods.

Storage containers for transporting goods are needed for a variety of applications including moving commercial goods in interstate transportation, moving a homeowner between residences, and moving a business between locations. Many of these moves are one-way, which means the storage container is only needed to travel from the departure point to its destination. After a one-way move, transporting a full-sized empty container back to its point of origin is inefficient. However, with a general trend of migration to certain parts of the country, many moves have no reciprocal return move. These various needs for transporting goods require a sturdy storage container adaptable to hold goods of different sizes and be able to be disassembled for shipment and storage of the container after emptying.

In today's moving industry, for example, typically a homeowner would move possessions from one residence to another by hiring a moving company which uses a moving van. The empty moving van is driven to the residence being vacated and the possessions are loaded into the van. The van is then transported to the new residence, where the possessions are unloaded. Considerable skill is required to load efficiently household goods in a large moving van due to the variety of sizes and shapes of typical household furniture and other goods.

Often a homeowner cannot directly move from one residence to another; rather, the homeowner must temporarily store the possessions in a warehouse before moving into the new residence. This extra step in the moving process subjects those possessions to additional risk of damage because of the extra handling and potentially inclement conditions incident to such an extra step in relocating.

The cost per cubic foot of space to move goods in this traditional fashion is driven by the costs associated with the tractor, van, labor to load and unload goods, maintenance, insurance, etc. Furthermore, the moving industry is very seasonal with 65% of all customers moving between the months of May and September. Accordingly, it becomes very expensive to maintain a fleet of trucks at one level during peak season and another in the off season. In the industry's attempt to adjust between seasonal demands, high turn-over and high fixed costs are incurred.

Through the use of a shipping and storage container which can be disassembled, the cost per cubic foot of providing moving space can be reduced. The container can be transported on any trailer and therefore the purchase of transportation from outside suppliers can be transacted on an as needed basis. Seasonal adjustments can be provided at a lower cost because the knock-down containers can be stored during the off season in warehouses without the associated turnover of labor. Professional labor to load and unload can be purchased in both the origin and destination cities for the move, thereby negating the need for loaders and unloaders having driving skills.

Many different containers have been used to attempt to solve the problems incident to moving. Some examples include the containers described in U.S. Pat. Nos. 3,655,087 (Luisada); 4,000,827 (Emery); 4,020,967 (Hammond); and 4,591,065 (Foy). However, problems with these containers have limited their effectiveness. One problem involves the difficulty of assembling and disassembling the container. For easy handling by unskilled persons, assembly of the container should not require any tools or special skill. Another problem involves transporting the containers when disassembled. The disassembled container frequently has a multiplicity of panels and connecting elements that can be lost, damaged, or destroyed when returned. To avoid such damage, the container should have a simple design which is easily transported in its disassembled state. Yet another problem with prior art containers is the method of joining the various panels which constitute the container. Many containers have joining elements which are difficult to operate, are easily broken during transportation, and have a multiplicity of elements which must be separately cared for when transported disassembled. Having simple and reliable joining elements facilitates the use and extends the working life of a container.

One type of prior art shipping container comprises a plurality of wooden panels having metal edge members connected thereto. The edge members are provided with rubber gaskets to seal one panel to an adjacent panel. Toggle-type latches are utilized to retain the container in its assembled condition. It has been found that normal wear and tear during loading and shipping and during assembly and disassembly of the panels results in damage to the rubber gaskets and to the toggle latches. This necessitates that the shipping containers be returned for frequent repair and reconditioning.

What is needed is a reusable knock-down transportation storage container which can withstand inclement weather conditions. Also needed is a container which is easy to assemble and disassemble and can be conveniently transported when disassembled. A further need is for a container having simple and reliable joining elements that are weathertight.

SUMMARY OF THE INVENTION

The knock-down shipping and storage container according to one form of the present invention comprises a plurality of identical side panels that are interlocked with a base and top wherein the side panels include universal edge joint structure that permits any side panel to interlock with any other side panel and form both edgewise butt joints and corner joints. The side panels are interlocked with the base and top and the side panels are further interlocked with each other by means of slide latch mechanisms that support each side panel in a vertical position relative to the two adjacent panels on both sides thereof. The slide latches slide outwardly from the edges of the side panels and are received in openings on the adjacent panels. To further retain the sides, top and base in assembled form, latch mechanisms fastening together the sides to the top and base can be utilized.

The joints between adjacent side panels and between the side panels and the top and base are constructed such that the flow of water into the container is resisted. This is accomplished by providing a tortuous path for water, which causes water to drip downwardly before it enters the interior of the container. All of the latching mechanisms, both those for the side panels and for the base and top, are recessed inwardly from the surface of the panels to minimize their being damaged during handling of the panels and assembled container. The exterior of the side panels is provided with extensive molded ribbing, which provides structural rigidity and strength to the panels. The panels are preferably molded from high density polyethylene, which imparts the desired strength and rigidity to the container and also has a somewhat lubricious surface that provides for a more water-tight seal between adjacent surfaces.

The universal nature of the edge joints for the side panels permits containers of varying size to be constructed merely by changing the base and top. For example, a large container could comprise six side panels, a base and top, and a smaller container could comprise four side panels and a smaller base and top. Also, since the side panels are universal, they can be matched with any other side panels, top and base, which greatly facilitates stocking and supply of the container components.

The present invention, in one form thereof, relates to a container for transportation and storage. It comprises a base and a plurality of interlocking side panels. Coupling means on lower edges of the side panels connect the side panels to the base so vertical movement of the side panels relative to the base is prevented. Latch means on vertical edges of the side panels interlock the side panels so the interlocked side panels are prevented from falling outwardly.

The transportation and storage container of the present invention alleviates the above-discussed problems incident to moving. By packing a homeowner's possessions into structurally sound containers, those possessions need only be handled twice, once during packing and once during unpacking. In addition, the containers deal effectively with the problems of damage to transported goods by reason of moisture or theft. Prior containers are typically made of wood and have not provided for resisting the penetration of water, but the present invention is preferably injection molded from high density plastic and is designed to resist water seepage.

In one embodiment of the present invention, plastic support braces provide a means for supporting shelves inside the container. The braces include slots at their ends which engage tether pins located on the interior side walls so the braces are supported by shoulders of the side wall and horizontally secured by the tether pins.

To further facilitate moving, the side panels have shelving recesses facing the interior portion of the container, which allow for a shelving support board to be supported between two opposing recesses. By this means, one is able to compartmentalize the shipping containers for more efficient packing.

DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
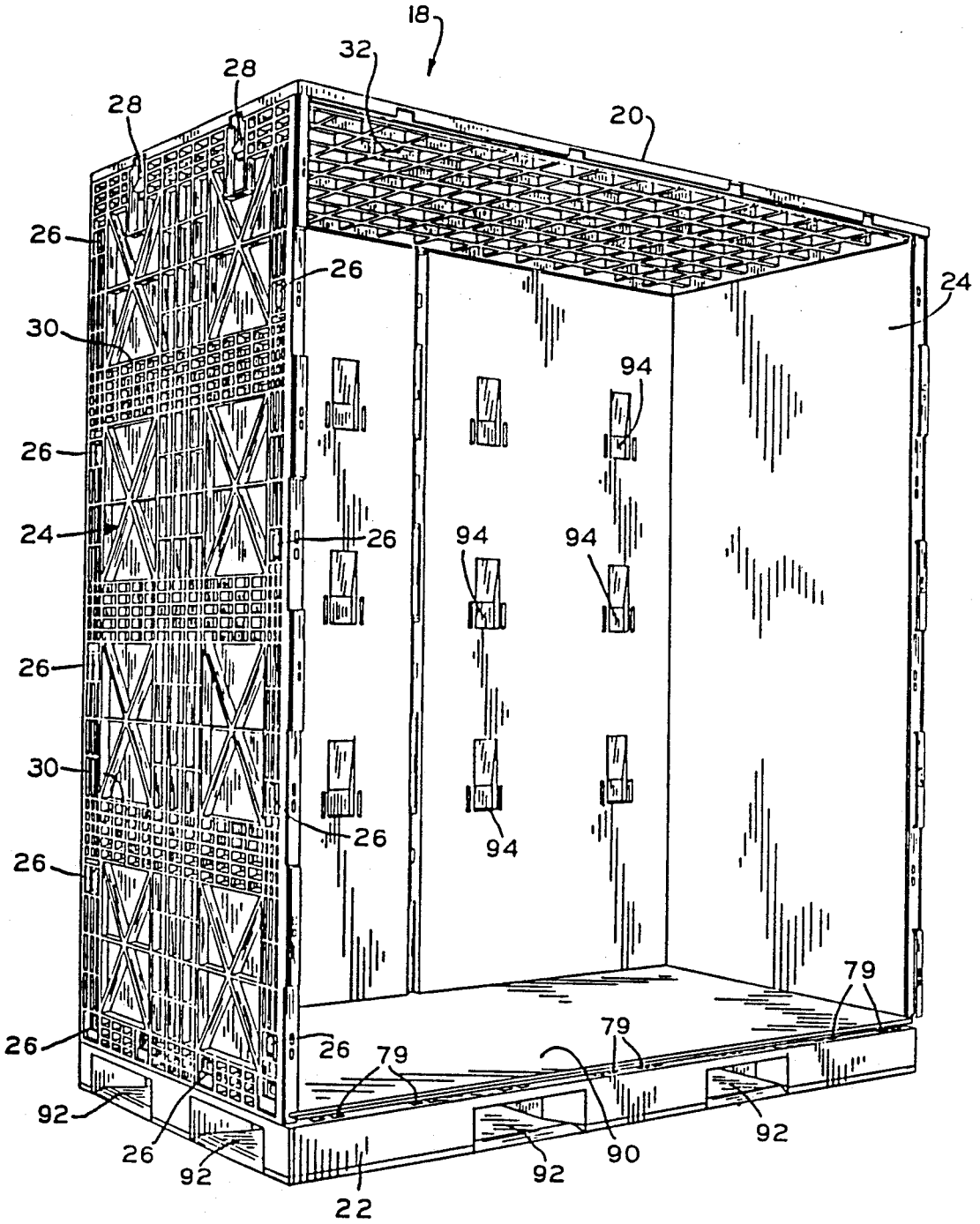
FIG. 1 is a perspective view of the universal storage container of the present invention.

The universal storage container 18 is shown in FIG. 1. Container 18 comprises a cover 20, a base 22, and a plurality of side panels 24. FIG. 1 shows a partially constructed container 18 having one left, one right and two back side panels 24, leaving its face open. To assemble container 18 completely, two additional side panels 24 are attached to form a front wall.

The three different pieces used to build container 18, namely, cover 20, base 22, and side panels 24, are molded from a high density plastic. In the preferred embodiment, the material used is high density polyethylene having both a tensile and compressive strength in the tens of thousands pounds per square inch. The use of a high strength molded thermoplastic material represents a significant advance over prior art shipping containers which are typically made of metal or wood. Molding of the side panels 24, top 20 and base 22 enables strengthening ribs to be formed integrally therewith and renders the container 18 resistant to water. The molded components are also relatively maintenance free because the edge structure forming the joints between adjacent panels is molded integrally and is extremely resistant to damage.

Figure 2:
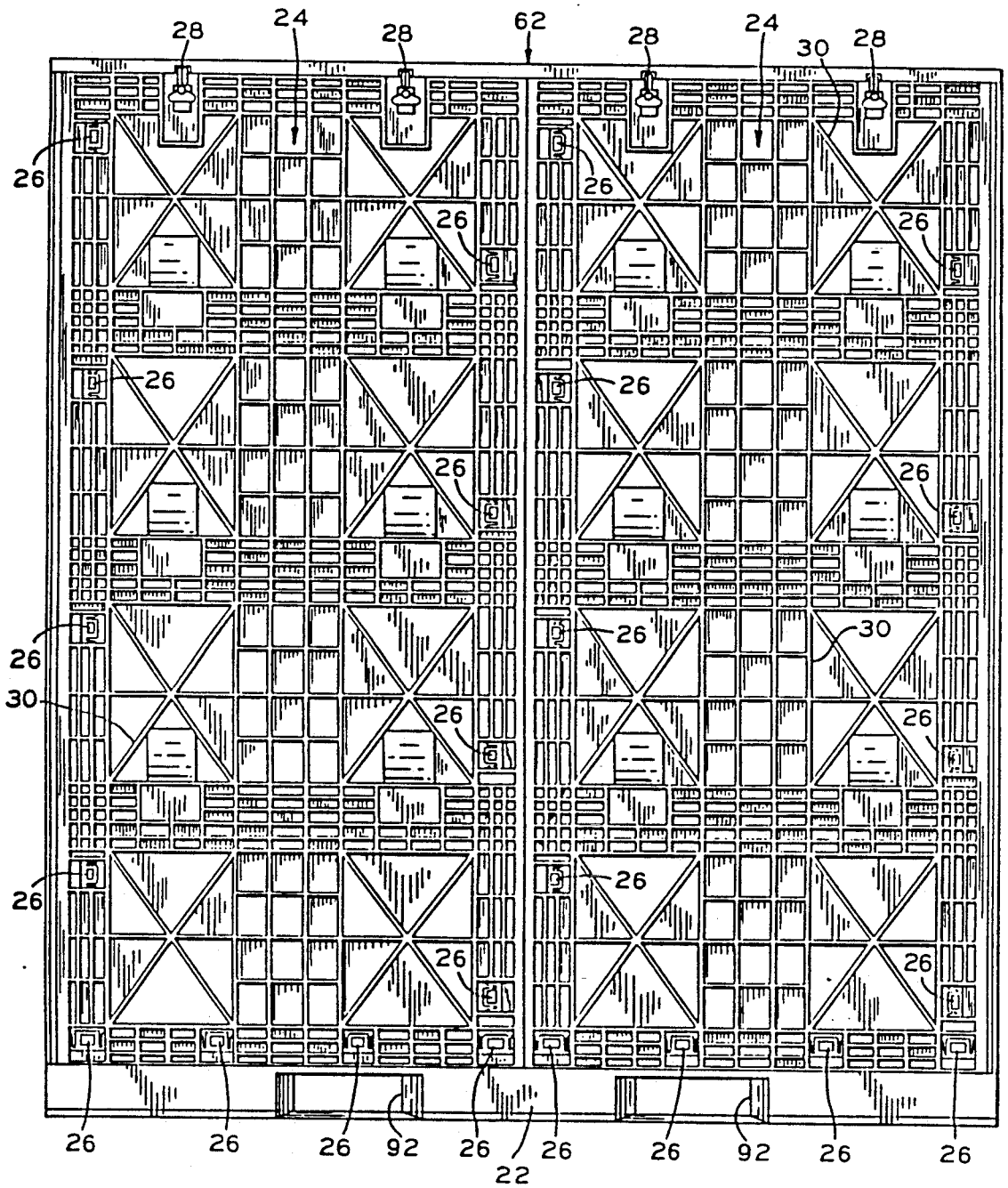
FIG. 2 is a vertical elevational view of two abutting side panels.

Four different types of connecting joints exist, the first between two abutting side panels 24, the second between two perpendicularly adjacent side panels 24, the third between cover 20 and upper edges of side panels 24, and the fourth between base 22 and lower edges of side panels 24. The structures of the differing connecting joints are further detailed below. Each side panel 24 has a plurality of recessed slide latches 26 located adjacent the vertical and lower edges. Latches 26 serve to couple adjoining side panels 24 and couple each side panel 24 to base 22. Also, side panels 24 have a plurality of recessed toggle latches 28 located on their upper and, optionally, their lower horizontal edge. Toggle latches 28 serve to clamp side panels 24 to cover 20 at their upper edges and to base 22 at their lower edges. As FIG. 2 shows, side panels 24 also have reinforcing ribbing 30 molded therein. Rib structure 30 is molded on an exteriorly facing side and is shaped to support the forces exerted on container 18. Top 20 is also provided with reinforcing ribbing 32 in a rectangular cell pattern, for example. The underneath side of base 22 is likewise provided with reinforcing ribbing (not shown). By virtue of slide latches 26 and toggle latches 8, side panels 24 interconnect the elements of container 18 to provide a structurally rigid and tough transportation and storage container.

Figure 5:
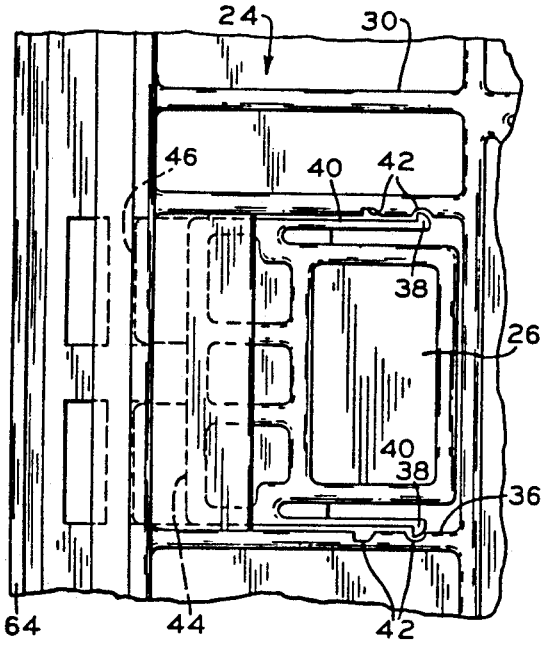
FIG. 5 is an enlarged fragmentary front view of the recessed slide latch for a corner joint.

Recessed universal latches attach and secure the vertical edges 34 of side panels 24 relative to one another. By proper joining of the vertical edges 34, side panels 24 interlock to form either coplanar panels or a perpendicular corner joint, thus preventing side panels 24 from falling over. A frontal view of latch 26 is shown in FIG. 5. The material used to fabricate latch 26 comprises ABS Triax, manufactured by the Monsanto Corporation of St. Louis, Mo.

Recessed universal latch 26 is located near a vertical edge 34 of side panel 24. Latch 26 is moved by manually gripping hand opening 36, then sliding latch 26 back and forth. The materials of the latch 26 and side panel 24 create a relatively frictionless sliding surface.

Detent ears 38 are on upper and lower edges of upper and lower resilient arms 40, respectively, of sliding latch 26 with ear 38 keyed to two notches in a cavity which holds universal latch 26 in side panel 24. Arm 40 is resilient when moved and locks so that latch 26 requires a significant amount of force to be moved when ear 38 is locked. One notch 42 positions latch 26 in the latched position, while the other positions it open.

Figure 9:
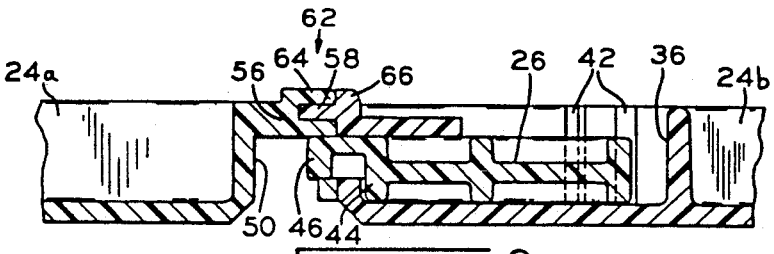
FIG. 9 is a sectional view of a universal butt joint connecting two abutting side panels.

At the end of latch 26 nearest vertical edge 34 is a locking bar 44. Two separate engaging teeth 46 jut out of locking bar 44 for engaging openings 48 in universal aperture 50 for a corner joint, as can be seen in FIGS. 6 and 7 or a butt joint as shown in FIG. 9.

The universal recessed sliding latches 26 can couple two adjacent side panels 24 when they are at a perpendicular angle and when they are relatively coplanar. By the universal design of latch 26 and the vertical edges 34 on both sides of side panels 24, every vertical edge 34 can be coupled to every other panel thus providing universal connections.

Figure 6:
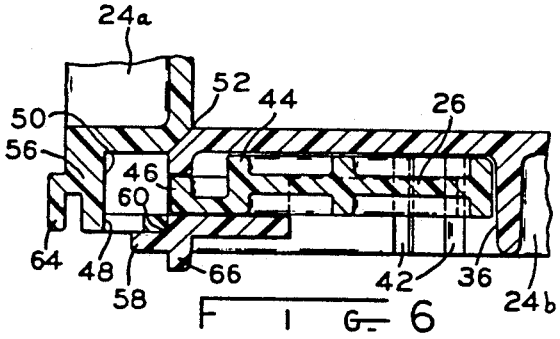
FIG. 6 is a longitudinal sectional view of the corner joint of FIG. 5 taken along line 6—6 of FIG. 5 in the direction of the arrows wherein the latch is open.
Figure 7:
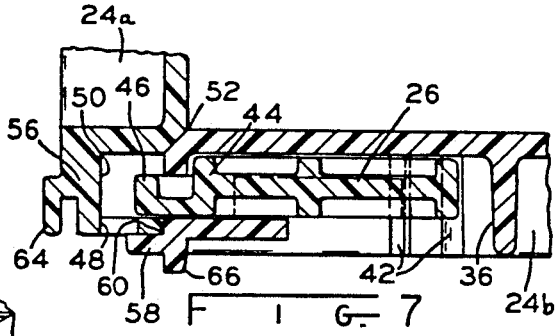
FIG. 7 is a sectional view similar to FIG. 6 with the latch closed.

A corner joint 52 is shown and described in FIGS. 3, 4, 6, 7, and 8. Two side panels **24*a* and 24*b* are at a perpendicular angle in FIG. 3, and are shown spaced apart in FIG. 4. Vertical edge 34 is at the end of ribbing structure 30 and has latching slits 54 located approximately equidistantly between two L-shaped interlocking edge extensions 56, with the length of the exposed section of vertical edge 34 and the length of extension 56 being approximately equal. Locking bar 44 is adapted to protrude through latching slits 54 of side panel 24*b* as shown in FIGS. 6 and 7. Aperture 50 receives locking bar 44 so that it keeps side panel 24*b* from falling forward (FIG. 7). In addition, another locking bar 44 (not shown) of side panel 24*a* can be placed in a corresponding aperture 50 of extension 56 of side panel 24*b* to keep side panel 24*a* from falling forward. By virtue of this interlocking between side panels 24*a* and 24*b*, corner joint 52** maintains both panels in a vertical position.

Figure 8:
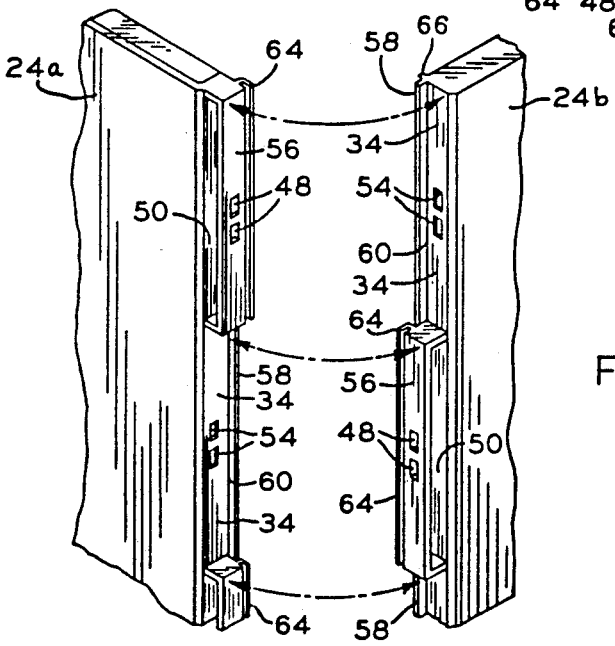
FIG. 8 is an exploded fragmentary perspective view of two side panels.

Extending from vertical edge 34 in a direction parallel with the exterior surface is flange 58, which extends beyond vertical edge 34 (FIG. 8). Extension 56 fits into a corner 60 formed by vertical edge 34 and flange 58 (FIGS. 6 and 7). Fitting extension 56 into corner 60 creates a tortuous path for water to traverse in order to penetrate into the interior of container 18. Water must first traverse a first bend to get between flange 58 and extension 56, then take a second bend at corner 60.

Figure 15:
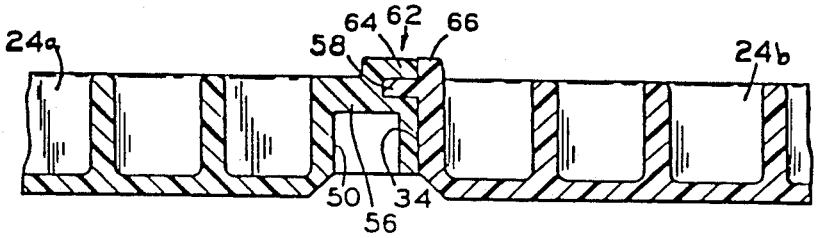
FIG. 15 is a sectional view of two abutting side panels.
Figure 17:
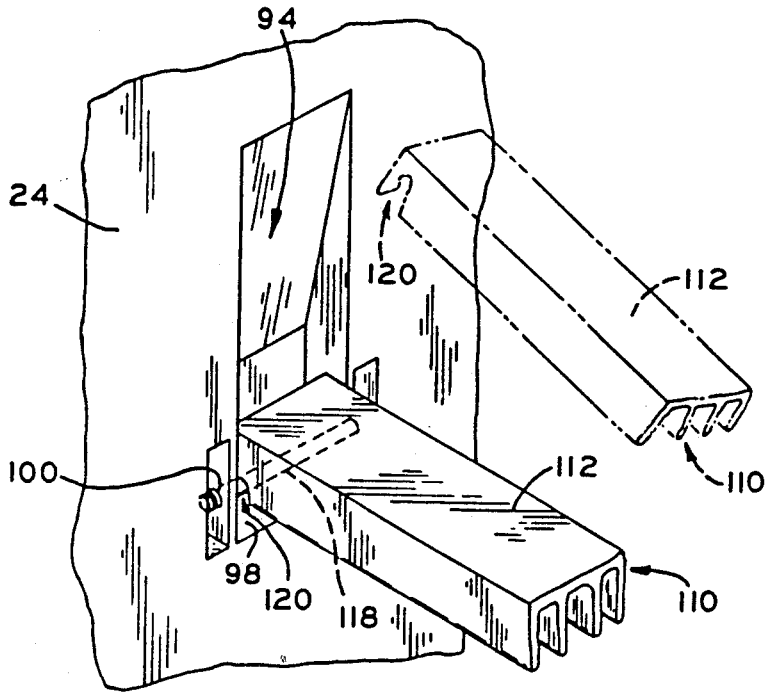
FIG. 17 is a perspective view of an alternative embodiment of the interior shelf support system.
Figure 18:
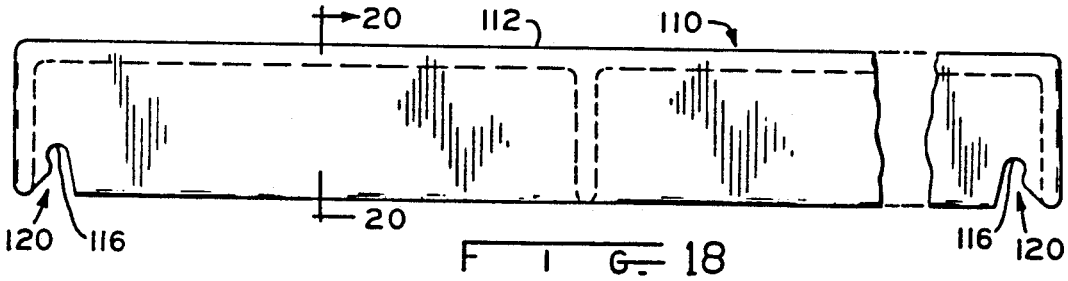
FIG. 18 is an elevational side view of the shelf brace of FIG. 17.
Figure 19:
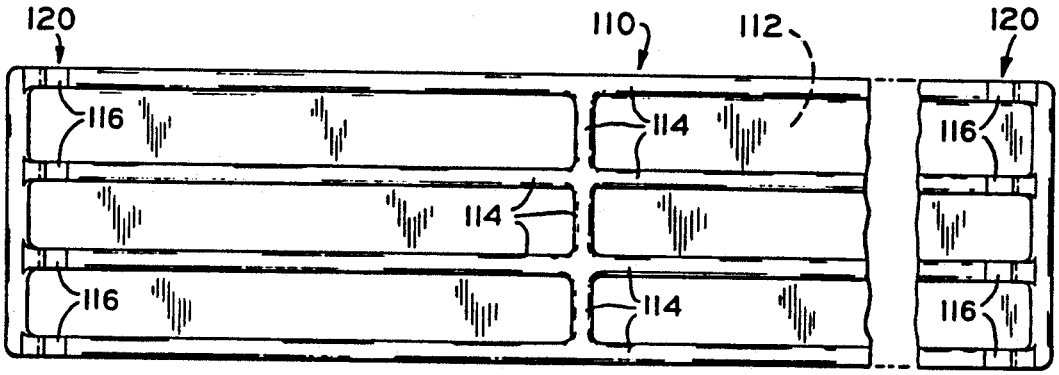
FIG. 19 is a bottom view of the brace.
Figure 20:
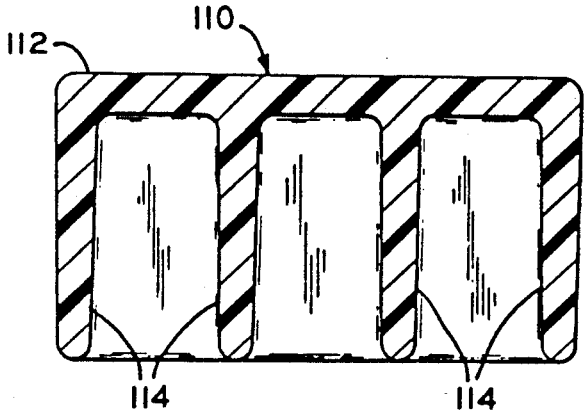
FIG. 20 is a cross sectional view of the brace taken along line 20—20 of FIG. 18.

As shown in FIGS. 9 and 15, two coplanar side panels **24*a* and 24*b* abut to form joint 62. Specifically, locking bar 44 of side panel 24*b* extends through opening 48 in extension 56 of side panel 24*a*. Extension 56 also engages flange 58 to create a tortuous path between side panels 24*a* and 24*b*. The tortuous path created is shown in a sectional view of the abutting joint 62 in FIG. 15. Edge portion 56 of side panel 24*a* fits into a corner formed by flange 58 and the vertical edge 34 of side panel 24*b*. Also, side panel 24*a* has a lip 64 on extension 56 which forms a groove to receive flange 58. When the side panels 24*a* and 24*b* are pushed together, lip 64 abuts against edge 66 of side panel 24*b*. Thus the tortuous path includes the adjacent sections of lip 64 and edge 66, adjacent sections of lip 64 and flange 58, to the adjacent section of extension 56 and flange 58, and finally to the adjacent sections of extension 56 and vertical edge 34**. This tortuous path impedes any penetration of moisture and creates a water-resistant seal.

Universal opening 50 is located in extension 56 of a side panel 24. The "L" shape of extension 56 forms a long cavity, with additional openings 48 in the farthest extending wall of extension 56 shaped to admit a locking bar 44. Locking bar 44 effects locking when side panels **24*a* and 24*b* are in an abutting or perpendicular position by entering either opening 48 or opening 50**, respectively.

Figure 10:
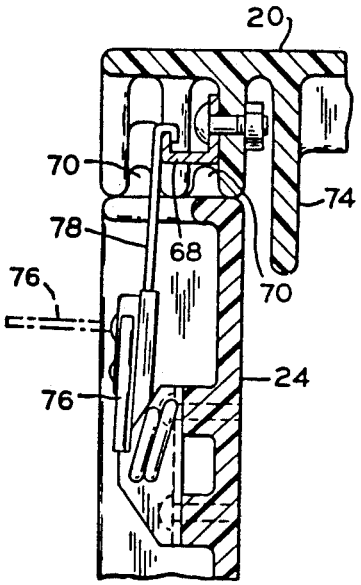
FIG. 10 is a sectional view of the recessed toggle latch.
Figure 11:
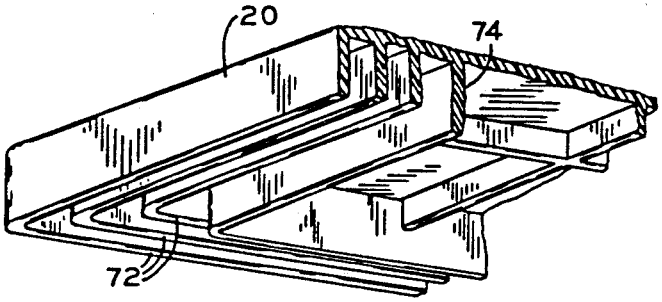
FIG. 11 is an exploded perspective view of a corner joint of two side panels and the cover.
Figure 11:
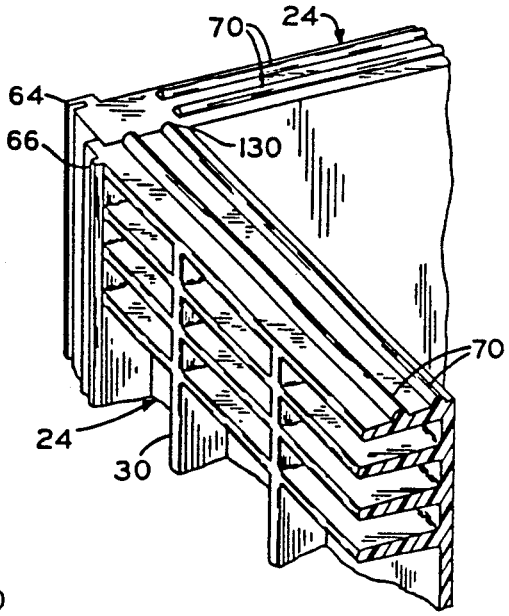
Figure 12:
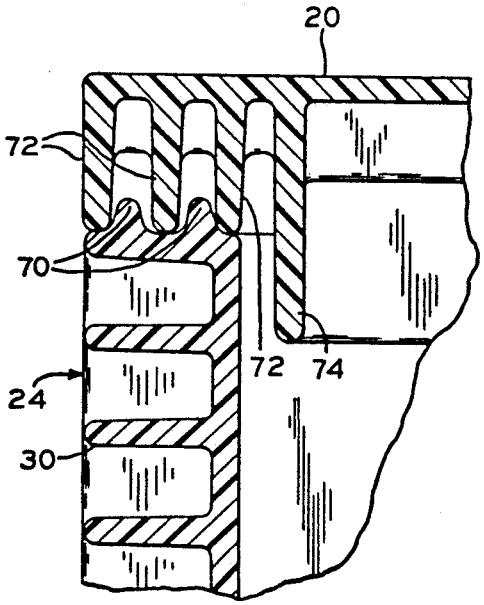
FIG. 12 is a sectional view of the joint between the upper edge of a side panel and the cover.

Referring to FIGS. 9–11, cover 20 comprises a molded panel with downwardly projecting ribs 32 used for the structural integrity of cover 20. Additionally, keeper plates 68 are bolted on its outer edges for engagement by toggle latches 28 on the upper edges of side panels 24. The structure of cover 20 is more particularly shown in FIGS. 10, 11 and 12.

Cover 20 is shown positioned directly over a corner joint 52 formed by two perpendicularly connected side panels 24 On the upper edges of side panels 24 are two rounded seal ribs 70, and extending downwardly from cover 20 near its edge are three seal ribs 72. When brought together in interlocking fashion, seal ribs 70 and 72 form a water resistant seal with cover 20. Flange 74 lies inwardly of seal ribs 72 and extends downwardly from cover 20 beyond the upper edge of side panel 24. By extending beyond the upper edge of cover 20, flange 74 serves to position cover 20 over the assembled side panels 24. Also, flange 74 provides for stability of cover 20 during movement. The meshing of seal ribs 70 and 72 creates a tortuous path which penetrating moisture must negotiate before entering the interior.

Recessed toggle latches 28 on side panels 24 provide a means to secure top 20 to side panels 24 (FIG. 10). In the preferred embodiment, recessed toggle latch 28 is a cam fastener (made by Simmons Fastener of Albany, N.Y.), which is bolted or screwed to side panel 24. Latch arm 76 moves latch hook 78 over keeper plate 68, which is fastened on cover 20. Latch hook 78 exerts downward pressure on keeper plate 68 when arm 76 is rotated to the solid line position of FIG. 9, thus securing cover 20 to side panel 24.

Base 22 is connected to side panel 24 by recessed sliding latches 26 (FIGS. 1 and 2), which are positioned near the lower edge of side panel 24. In the preferred embodiment, four latches 26 are employed to secure this connection, two located at approximately equidistant positions along the lower edge and the other two at the lower corners. Toggle latches 28 may also be used.

Figure 13:
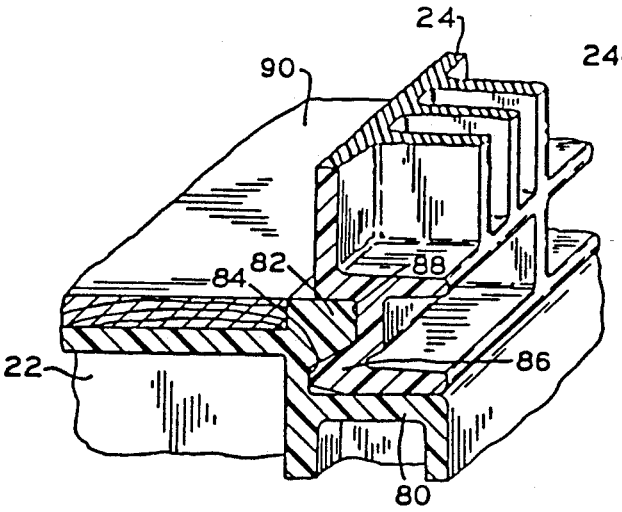
FIG. 13 is a sectional view of the joint between lower edge of a side panel and the base.

Openings 79 in base 22 are shaped to receive two engaging teeth 46 of locking bar 44. Teeth 46 extend downwardly into holes 79 in base 24 to set side panel 24 securely against base 22. Referring to FIG. 13, base 22 comprises a shoulder 80 and a rib 82, with rib 82 being spaced above shoulder 80 and defining a groove 84. Side panel 24 has a lower edge from which a protruding tongue 86 extends. By properly positioning the lower edge of side panel 24 on shoulder 80, protruding tongue 86 extends into the groove between outer rib 82 and shoulder 80, positively engaging base 22, groove 88 and rib 82. Then latches 26 on the lower edge of side panel 24 are downwardly engaged, thus connecting base 22 to side panels 24 and securing the two against both vertical and lateral movement.

Base 22 is used to support the contents of container 18, as well as serving to support side panels 24. In the preferred embodiment, base 22 comprises a single molded piece. On base 22, wooden floor 90 is fastened to its upper surface. In the preferred embodiment, that upper surface has a plurality of reinforced holes (not shown) to allow wooden floor 90 to be secured by screws which are received in the holes in base 22. Under floor 90 and its supporting molding are molded forklift slots 92 Shaped to admit twin fingers from a forklift, slots 92 are located on all four sides to allow container 18 to be lifted and transported, with base 22 supporting the structure and contents of container 18.

In addition to stacking contents on floor 90, the present invention provides for shelves within in the interior of container 18. In the preferred embodiment, each side panel 24 has six shelving recesses 94 positioned as pairs at approximately one quarter, one half, and three quarters of the panel's height, as can be seen in FIG. 1. Each pair of shelving recesses 94 are located at approximately one and three quarters of the panel's width.

Figure 14:
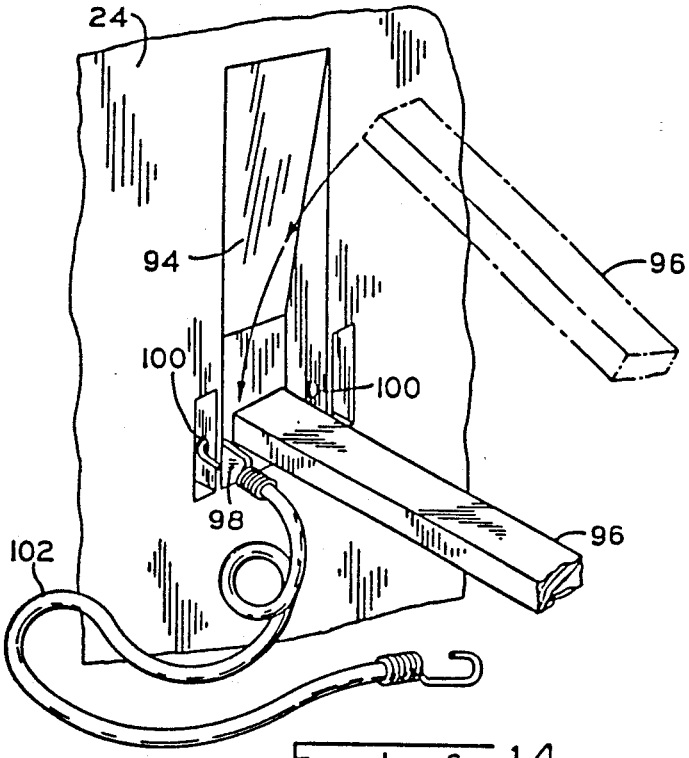
FIG. 14 is a fragmentary perspective view of the interior shelf support system.

A perspective view of a shelving recess 94 is shown in FIG. 14, with a shelf support board 96 supported on shoulder 98 which is the bottom of shelving recess 94. Shelf board 96 is separate from the structure of container 18, and in the preferred embodiment a two-by-four wooden board is used. On each side of shelving recess 94 is a tie down hole 100. An elastic restraining cord 102 can be used to secure contents of container 18 by tauntly positioning the secured object to an interior wall of container 18.

Figure 16:
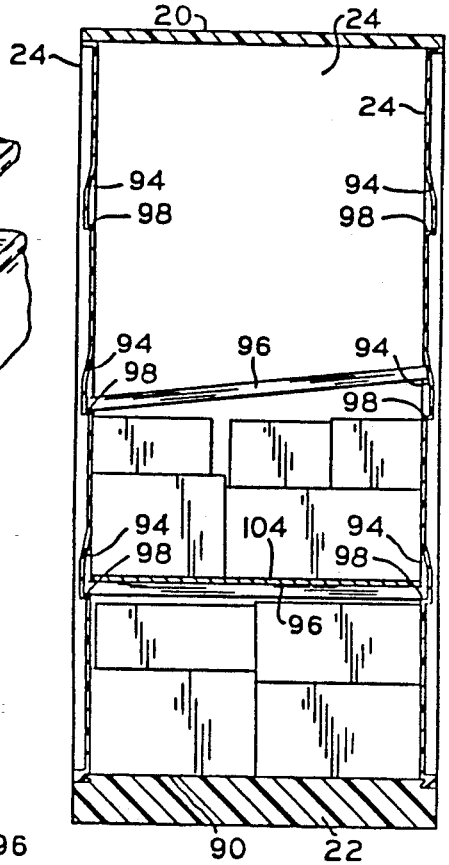
FIG. 16 is an end view of the container with an end panel removed.

Recess 94 is shaped to allow a first end of board 96 to angularly pivot about the second end of board 96. FIG. 16 shows oppositely positioned shelving recesses 94 supporting a shelf board 96. Shelf support boards 96 are used in pairs between oppositely positioned shelving recesses 94 to provide support to a shelf plate 104, on which various items are placed. Shelf plate 104 can be made from a variety of materials, and in the preferred embodiment it comprises a plywood sheet.

Figure 3:
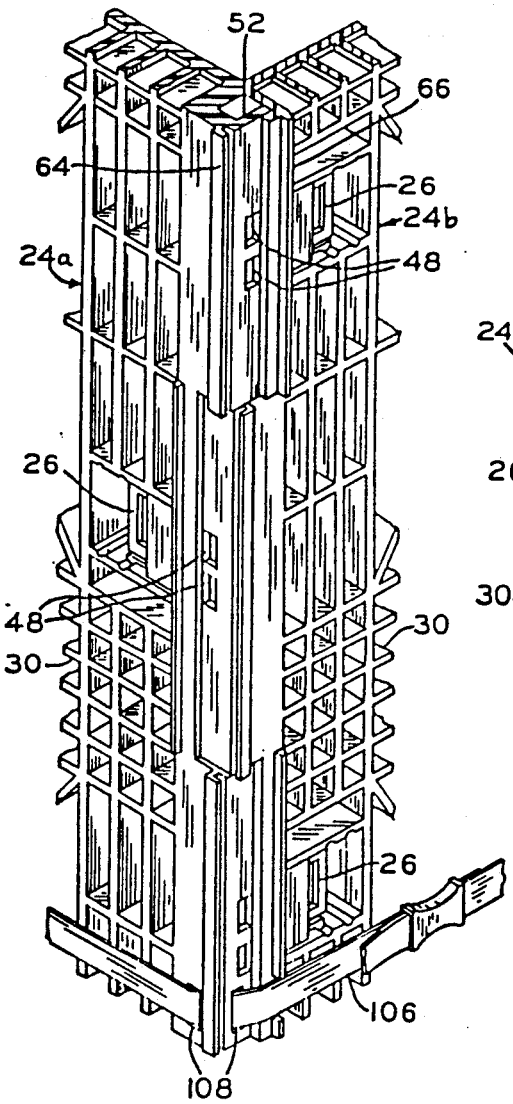
FIG. 3 is an enlarged fragmentary perspective view of two side panels forming a corner joint.
Figure 4:
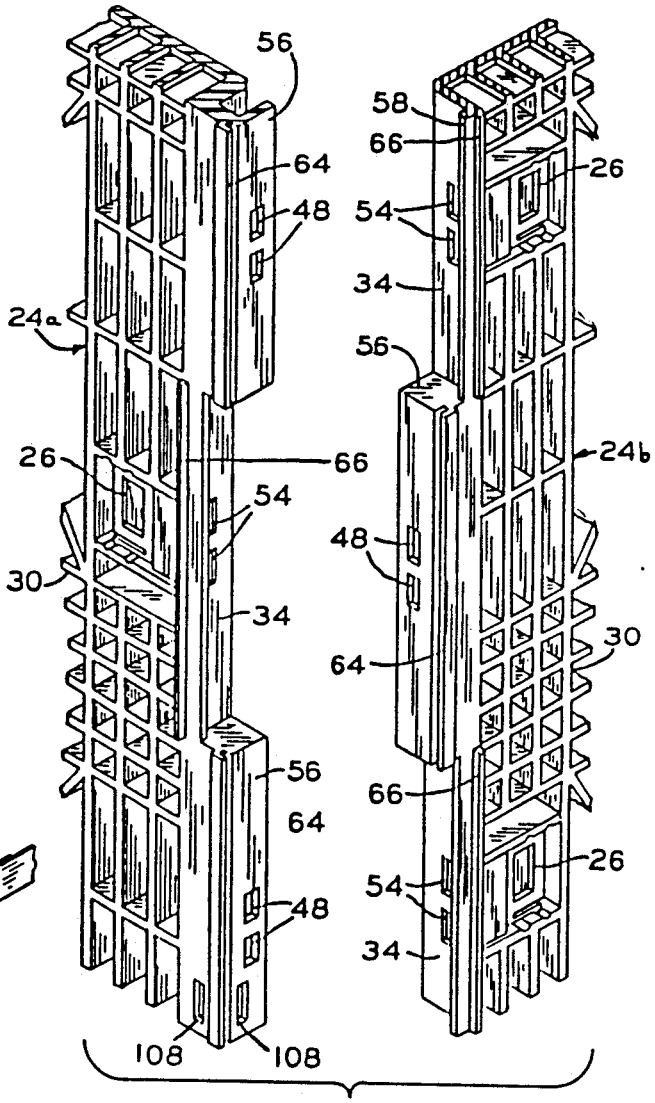
FIG. 4 is similar to FIG. 3 with the two side panels separated.

The present invention also provides for easily positioning sealing bands 106 (FIG. 3) around a closed container. By sealing and certifying the seal, the owner of the contents can verify the container has not been tampered with if the seal remains intact at its destination. For the preferred embodiment, three relatively thin and resilient strapping bands 106 are wrapped about container 18, securely fastened together, and sealed. Strapping bands 106 can be nylon bands, ropes, wires, metal bands, or other means of securing the side panels 24. One band is positioned horizontally around the perimeter of side panels 24, through band holes 108 which are located on the midpoint of each vertical side of side panel 24 (FIG. 3). The other two bands (not shown) are positioned vertically around cover 20, base 22, and side panels 24 through forklift holes 92. Both cover 20 and base 22 provide guiding grooves to help position the bands 106.

The container 18 is easily assembled, with only cover 20, base 22, and side panels 24 needed. Assembly commences by placing two side panels 24 at a corner of base 20. Protruding tongues 86 of side panels 24 are located within groove 84 of base 20, then vertical edges 34 are brought together. Sliding latches 26, along vertical edges 34 which form a corner like corner 52, are moved into a locking position (FIG. 7). Also, sliding latches 26 located along the bottom edge of side panels 24 are moved into locking positions with holes 79 in base 20. Two side panels 24 interlocked in a corner joint with base 20 creates a self-standing structure.

Next, the recommended procedure involves completing three sides of the rectangle which is defined by base 20. Each additional side panel 24 is connected to the structure of container 18 by sliding protruding tongue 86 into groove 84 at an unoccupied section of base 20, then pushing vertical edges 34 of adjacent side panels 24 together, and finally engaging sliding latches 26 into appropriate openings thus interlocking adjacent side panels. When three sides are assembled, cover 22 is placed on the upper edges of side panel 24, and secured in place by operation of toggle latches 28 (see FIG. 10). Using the aforementioned procedure, container 18 would be as it appears in FIG. 1. With one side open, items to be shipped are packed into container 18. When packing is completed, container 18 is closed and sealed. To close, the remaining side panels 24 are connected as before. The last side panel 24 connected should form a corner, and that panel is carefully fitted into that corner at an angle, before pivoting last side panel 24 into an abutting position. As with other side panels 24, sliding latches 26 are engaged at both vertical edges 34 and with base 20.

Optionally, before packing, shelves can be installed within container 18 (see FIG. 16). The ends of board 96 are set upon shoulders 98 of side panels 24 (see FIG. 14), so first one end of a board 96 is placed on a shoulder 98 and the board 96 is pivoted down into its corresponding recess 50, which is in the oppositely facing side panel 24. After placing the boards 96, a shelf plate 104 is set on the boards 96. Items are placed on the plates 104 during packing, then the container is closed as described above.

An alternative embodiment of the present invention using plastic shelving boards is depicted in FIGS. 17–20. Plastic support brace 110 is shaped like a conventional wood 2×4 board and may be fabricated from a suitable hard plastic material such as high density polyethylene. Top surface 112 is supported by ribs 114 so brace 110 provides a similar supporting surface for furniture, boxes, shelving, etc. In addition to being more resistant to deterioration than wood, notches 116 are easily included in the molding of brace 110 for hooking and locking onto tether pins 118 located in shelving recesses 94. Tether pins 118 may be fabricated from a suitable metallic material.

Assembling container 18 with braces 110 is similar to the previously discussed assembly, with the additional step of inserting tether pin 118 into recess 94. The ends of tether pin 118 fit into both tie down holes 100 and pin 118 extends between holes 100 in recess 94. Pins 118 may include annular grooves (not shown) near their ends to engage the perimeter of holes 100. Brace 110 should be snap fit onto tether pin 118 so that it extends into slot 116 to prevent any horizontal displacement of brace 110. The resulting locking connection still allows shoulder 98 to support brace 110, and tether pin 118 limits the horizontal movement of brace 110.

If desired, container 18 can be used without cover 20 in the storage and handling of goods in a covered, inside environment, such as warehouses, and mail handling facilities. Furthermore, the sides of the containers can be shortened as appropriate for the particular application.

Figure 21:
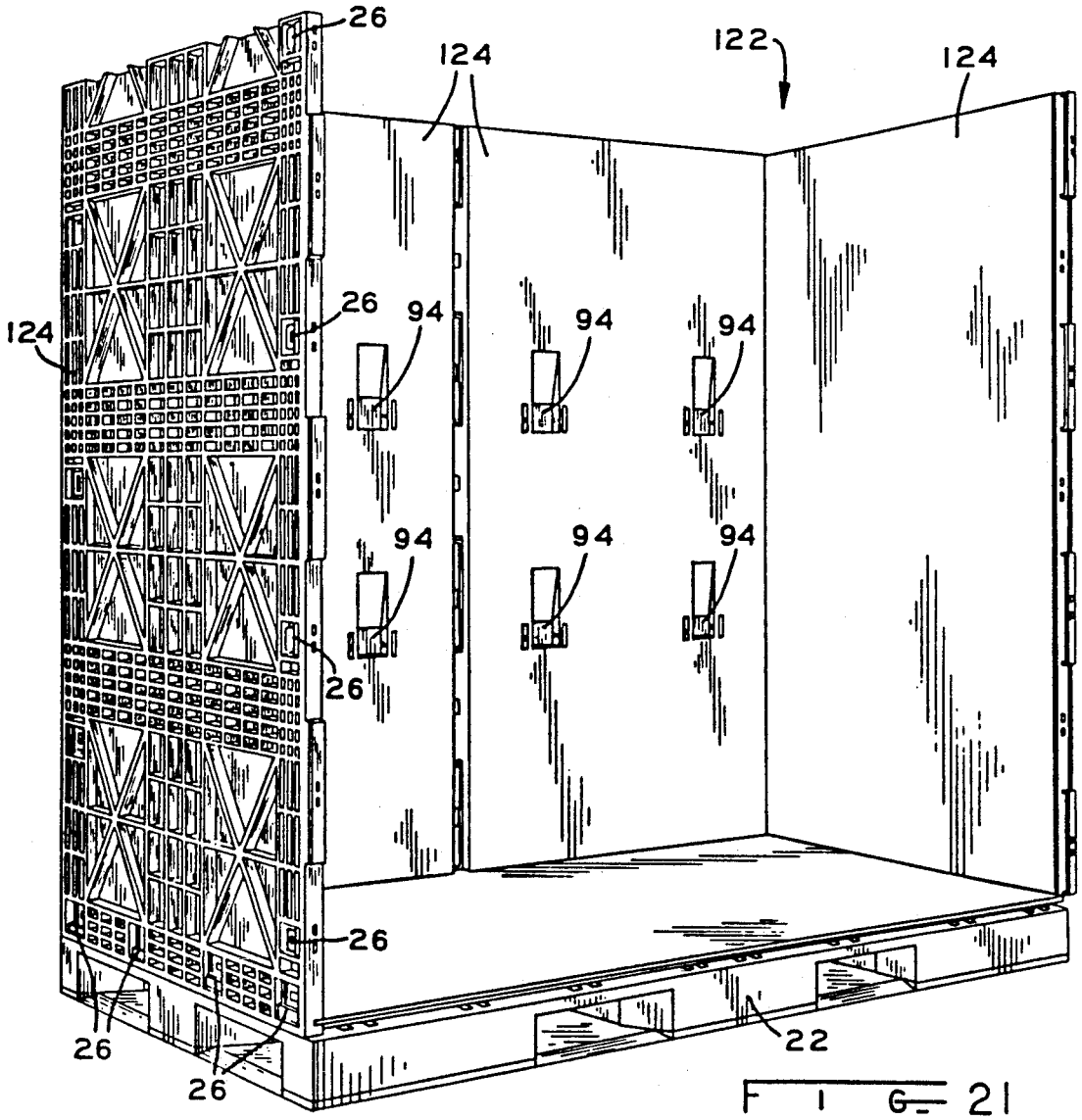
FIG. 21 is a perspective view of the universal storage container of the present invention with the top removed.

Coverless universal storage container 122 is an alternate embodiment of the present invention and is depicted in FIG. 21. Base 22 provides a bottom for container 122, and side panels 124 are assembled to provide sides. Side panels 124 are structured similarly to side panels 24, but differ in that they are shorter and have no means for connecting with a cover at their upper ends. Container 122 is useful for shipping and storage applications which require greater access to the contents of the container, such as a mail bin.

While this invention has been described as having a preferred design, it will be understood that it is capable of further modification. This application is therefore intended to cover any variations, uses, or adaptations of the invention following the general principles thereof and including such departures from the present disclosure as come within known or customary practice in the art to which this invention pertains and fall within the limits of the appended claims.

What is claimed is:

1. A disassemblable container for transportation and storage comprising:

a base; and a plurality of side panels coupled to said base, each of said side panels having at least one coupling means at a lower edge for coupling to said base such that vertical movement of said side panels relative to said base is prevented, and interlocking means at vertical edges of said side panels for interlocking said side panels such that said interlocked side panels are prevented from falling outwardly from a vertical position, said interlocking means further comprising a first joint extending along the interlocked vertical edges;

said coupling means being permanently mounted on one of said base and said side panels;

said interlocking means being permanently mounted on one of adjacent said side panels;

said coupling means and said interlocking means being fully self-contained on said container and permanently attached thereto even when said container is disassembled;

said interlocking means comprises a plurality of apertures and latching means interleaved at said vertical edges, said latching means capable of latching said apertures of adjacent said side panels alternatively in two positions: a first position defined by two of said side panels being in a relatively perpendicular position to form a 90° corner joint, and a second position defined by two of said side panels being in a relatively coplanar, abutting position, said interlocked vertical edges forming a tortuous joint having at least two bends collectively totaling at least a 180° change of direction, said interlocked base and lower edges forming a tortuous joint having at least two bends collectively totaling at least a 180° change of direction.

2. The container of claim 1 wherein said latching means further comprises a latch recess and a sliding latch, said latch recess shaped to receive and position said sliding latch in at least two latch positions: a first latch position wherein said sliding latch is substantially located within said latch recess, and a second latch position wherein said sliding latch extends partially outside of said latch recess such that said sliding latch extends into one of said apertures of an adjacent said side panel.

3. The container of claim 1 wherein said vertical edges further comprise a flange forming said first joint with an adjacent side panel having at least two 90° bends forming a tortuous path for water whereby said first joint is water-resistant.

4. The container of claim 1 wherein said side panels and base are injection molded plastic.

5. The container of claim 1 wherein said lower edges of said side panels and said base are shaped such that, when connected, at least two 90° bends exist between said side panel and said base, said bends forming a second joint with a tortuous path for water whereby said second joint between said side panel and the base is water-resistant.

6. The container of claim 1 wherein said interlocking means and said coupling means are positioned within recesses of said side panels such that when said container is assembled, no substantial part of any one of said interlocking means and coupling means protrudes beyond the plane defined by the exterior surface of the respective said side panel.

7. The container of claim 1 wherein said base has at least one pair of forklift openings for allowing forklift forks to enter said forklift openings and raise said container.

8. The container of claim 1 wherein said side panels have holes on said vertical edges adapted to receive strapping bands.

9. The container of claim 1 wherein said side panels have a plurality of support ribs molded on the exterior face of said side panels.

10. A disassemblable container for transportation and storage comprising:

a base;

a plurality of interlocking side panels coupled to said base, each of said side panels having at least one coupling means at a lower edge for selectively coupling said side panels to said base and uncoupling said side panels from said base, and at least one interlocking means at vertical edges of said side panels for selectively interlocking and unlocking said side panels;

said interlocking means comprising a first joint in each of said relative positions extending along the interlocked vertical edges forming a tortuous path for water thereby rendering said first joint water resistant;

said side panels forming with said base second joints forming tortuous paths for water thereby rendering said second joint water resistant;

each of said side panels facing a corresponding opposite side panel such that said side panel and corresponding opposite side panel are relatively parallel and have interior walls facing each other; and at least one shelving means supported on interior walls of said side panels for supporting goods in said container;

said side panels having a plurality of shelving recesses located at fixed positions within interior walls of said side panels for supporting said shelving means between corresponding opposite said side panels, said interior walls having a shoulder defining the bottom of said shelving recesses, said shoulder adapted to support said shelving means, said shelving means at least partially located within said shelving recesses and supported on said shoulders of said corresponding side panels.

11. The container of claim 10 wherein said interlocking means comprises a plurality of apertures and latching means interleaved at said vertical edges, said latching means selectively interlocking with certain ones of said apertures of said adjacent side panel in a first position, said first position defined by two of said side panels being in a relatively perpendicular position, and a second position, said second position defined by two of said side panels being in a relatively coplanar, abutting position.

12. The container of claim 11 wherein said side panels and base are injection molded plastic elements.

13. The container of claim 12 wherein said base has at least one pair of forklift openings for allowing forklift forks to enter said forklift openings and raise said container.

14. The container of claim 10 wherein said shelving means includes an elongated plastic brace.

15. The container of claim 14 wherein said plastic brace includes a top surface and a plurality of supporting ribs under said top surface.

16. The container of claim 14 wherein said side panels have at least one tether pin located in said shelving recesses and said plastic brace includes at least one slot adjacent an end of said plastic brace, said slot having a shape whereby said plastic brace is capable of engaging and locking on said tether pin.

17. The container of claim 10 wherein said side panels have at least one tether pin located in said shelving recesses and said shelving means includes a means for engaging said tether pin.

18. A disassemblable container for transportation and storage comprising:

a base;

a plurality of side panels coupled to said base, each of said side panels having at least one coupling means at a lower edge for coupling to said base such that vertical movement of said side panels relative to said base is prevented, and interlocking means at vertical edges of said side panels for interlocking said side panels such that said interlocked side panels are prevented from falling outwardly from a vertical position, said interlocking means further comprising a first joint extending along the interlocked vertical edges;

said side panels being detachable from each other and from said base;

said coupling means being permanently mounted on one of said base and said side panels;

said interlocking means being permanently mounted on one of adjacent said side panels;

said coupling means and said interlocking means being fully self-contained on said container and permanently attached thereto even when said container is disassembled;

a plurality of sliding latches on one of said base and side panels;

the other of said base and side panels including a plurality of openings shaped to receive respective said latches, whereby said side panels and base are interlocked together;

said interlocked vertical edges forming a tortuous joint having at least two bends collectively totaling at least a 180° change of direction, said interlocked base and lower edges forming a tortuous joint having at least two bends collectively totaling at least a 180° change of direction.

19. The container of claim 18 wherein said sliding latches and said latching means are positioned within recesses of said side panels such that when said container is assembled, no substantial part of any one of said sliding latches and latch means protrudes beyond the plane defined by the exterior surface of the respective said side panel.

20. The container of claim 18 wherein said side panels and base are injection molded plastic.

* * * * *